US009464468B2

(12) United States Patent
Yuan

(10) Patent No.: US 9,464,468 B2
(45) Date of Patent: Oct. 11, 2016

(54) LOCKING MECHANISM AND PORTABLE ELECTRONIC APPARATUS

(71) Applicant: Wistron Corporation, New Taipei (TW)

(72) Inventor: Peter Yuan, New Taipei (TW)

(73) Assignee: Wistron Corporation, New Taipei (TW)

( * ) Notice: Subject to any disclaimer, the term of this patent is extended or adjusted under 35 U.S.C. 154(b) by 439 days.

(21) Appl. No.: 13/916,560

(22) Filed: Jun. 12, 2013

(65) Prior Publication Data

US 2014/0312628 A1 Oct. 23, 2014

(30) Foreign Application Priority Data

Apr. 17, 2013 (CN) ..... 2013 1 0134428

(51) Int. Cl.
*E05C 3/12* (2006.01)
*E05B 65/00* (2006.01)
*E05C 19/16* (2006.01)

(52) U.S. Cl.
CPC ..... *E05C 3/124* (2013.01); *E05B 65/0067* (2013.01); *E05C 19/163* (2013.01); *Y10T 292/0926* (2015.04); *Y10T 292/0948* (2015.04)

(58) Field of Classification Search
CPC ... E05B 65/0067; E05C 19/163; E05C 3/124
See application file for complete search history.

(56) References Cited

U.S. PATENT DOCUMENTS

2006/0056140 A1 3/2006 Lev
2008/0174971 A1* 7/2008 Liu ..... E05B 63/248 361/732
2010/0052334 A1* 3/2010 Hart ..... A61G 5/1075 292/4
2011/0026203 A1* 2/2011 Ligtenberg ..... E05C 19/16 361/679.01
2012/0206873 A1 8/2012 Schwager

FOREIGN PATENT DOCUMENTS

TW 508045 10/2002

OTHER PUBLICATIONS

Office action mailed on Mar. 23, 2015 for the Taiwan application No. 102116087, filing date: May 6, 2013, p. 2 line 5~26, p. 3~12 and p. 13 line 1~9.

* cited by examiner

*Primary Examiner* — Kristina Fulton
*Assistant Examiner* — Thomas Neubauer
(74) *Attorney, Agent, or Firm* — Winston Hsu; Scott Margo

(57) ABSTRACT

A locking mechanism includes a hooking component, an engagement structure, and an actuation component. The hooking component is disposed in a casing of a portable electronic apparatus. The engagement structure and the actuation component are disposed in another casing of the portable electronic apparatus. The actuation component is slidable relatively to the casing and includes a magnetic portion. When the magnetic portion approaches a hooking part of the hooking component, the hooking part is rotated out of the casing by a magnetic effect to hook the engagement structure; when the actuation component slides such that the magnetic portion is moved away from the hooking part, because a force generated by the magnetic effect to the hooking part decreases, a resilient part of the hooking component can drive the hooking part to disengaged from the engagement structure to rotate into the casing.

9 Claims, 7 Drawing Sheets

LOCKING MECHANISM AND PORTABLE ELECTRONIC APPARATUS

BACKGROUND OF THE INVENTION

1. Field of the Invention

The invention relates to a locking mechanism and a portable electronic apparatus, and especially relates to a locking mechanism capable of locking two relatively moveable casings, and a portable electronic apparatus having the locking mechanism.

2. Description of the Prior Art

For a conventional notebook, its upper cover and its base are pivotally connected by a hinge device so that the notebook can be opened for use or closed for storage. When the notebook is at a closed state, for avoiding the upper cover and the base from being opened unexpectedly, the upper cover and the base are kept closed by disposing a hooking mechanism on the upper cover and the base correspondingly relative to the hinge device, or by using a hinge device capable of auto-locking. However, the design of using the hinge device capable of auto-locking will increase the difficulty in designing the hinge device. Furthermore, after a long time of opening and closing the notebook through the hinge device, the locking force of the hinge device tends to be unstable due to unavoidable abrasion therein. The design of using the hooking mechanism can avoid the above abrasion issue. A less locking force is required for the hooking mechanism to keep the upper cover and the base at the closed state. But the hook of the hooking mechanism usually protrudes out of the casing. Such structure configuration is unsightly to the product appearance.

SUMMARY OF THE INVENTION

Therefore, a locking mechanism according to one embodiment of the invention is provided. The locking mechanism is capable of locking a first casing and a second casing, for example a base and an upper cover of a notebook pivotally connected by a hinge, but the invention is not limited thereto. The locking mechanism includes a hooking component, an engagement structure, and an actuation component. The hooking component is disposed in the first casing and includes a hook and a resilient part. The hook has a first magnetic portion and is capable of rotating relative to the first casing to extend out of the first casing through an opening of the first casing. The resilient part is connected to the hook for providing a first moment to the hook to urge the hook to rotate into the first casing. The engagement structure is fixedly disposed on the second casing corresponding to the opening such that the hook is capable of hooking the engagement structure. The actuation component is slidably disposed in the second casing corresponding to the hooking component and includes a second magnetic portion. When the second magnetic portion is located at a locking position and the actuation component is close to the hooking component, a second moment produced by a magnetic effect induced between and by the first magnetic portion and the second magnetic portion to the hook is larger than the first moment so that the hook rotates out of the first casing to hook the engagement structure. When the actuation component slides such that the second magnetic portion is away from the locking position, i.e. the second magnetic portion being away from the first magnetic portion, the second moment is less than the first moment so that the hook disengages from the engagement structure to rotate into the first casing.

Furthermore, a portable electronic apparatus according to one embodiment of the invention is provided. The portable electronic apparatus uses the locking mechanism according to the invention. The portable electronic apparatus includes a first casing, a second casing, a pivotal connecting device, and a locking mechanism. The first casing has an opening. The first casing and the second casing are pivotally connected by the pivotal connecting device. The locking mechanism includes a hooking component, an engagement structure, and an actuation component. The hooking component is disposed in the first casing and includes a hook and a first resilient part. The hook has a first magnetic portion and is capable of rotating relative to the first casing to extend out of the first casing through an opening of the first casing. The first resilient part is connected to the hook for providing a first moment to the hook to urge the hook to rotate into the first casing. The engagement structure is fixedly disposed on the second casing. When the first casing and the second casing are closed, the engagement structure is opposite right to the opening such that the hook is capable of hooking the engagement structure. The actuation component is slidably disposed in the second casing corresponding to the hooking component and includes a second magnetic portion. When the second magnetic portion is located at a locking position and the first casing and the second casing are closed, the actuation component is close to the hooking component and a second moment produced by a magnetic effect induced between and by the first magnetic portion and the second magnetic portion to the hook is larger than the first moment so that the hook rotates out of the first casing to hook the engagement structure so as to lock the first casing and the second casing. When the actuation component slides such that the second magnetic portion is away from the locking position, i.e. the second magnetic portion being away from the first magnetic portion, the second moment is less than the first moment so that the hook disengages from the engagement structure to rotate into the first casing so as to unlock the first casing and the second casing.

These and other objectives of the present invention will no doubt become obvious to those of ordinary skill in the art after reading the following detailed description of the preferred embodiment that is illustrated in the various figures and drawings.

DETAILED DESCRIPTION

The invention is to provide a locking mechanism according capable of locking a first casing and a second casing. The locking mechanism includes a hooking component, an engagement structure, and an actuation component. The hooking component is disposed in the first casing and includes a hook and a resilient part. The hook has a first magnetic portion and is capable of rotating relative to the first casing to extend out of the first casing through an opening of the first casing. The resilient part is connected to the hook for providing a first moment to the hook to urge the hook to rotate into the first casing. The engagement structure is fixedly disposed on the second casing corresponding to the opening such that the hook is capable of hooking the engagement structure. The actuation component is slidably disposed in the second casing corresponding to the hooking component and includes a second magnetic portion. When the second magnetic portion is located at a locking position and the actuation component is close to the hooking component, a second moment produced by a magnetic effect induced between and by the first magnetic portion and the second magnetic portion to the hook is larger than the first moment so that the hook rotates out of the first casing to hook the engagement structure. When the actuation component slides such that the second magnetic portion is away from the locking position, i.e. the second magnetic portion being away from the first magnetic portion, the second moment is less than the first moment so that the hook disengages from the engagement structure to rotate into the first casing.

Figure 1:
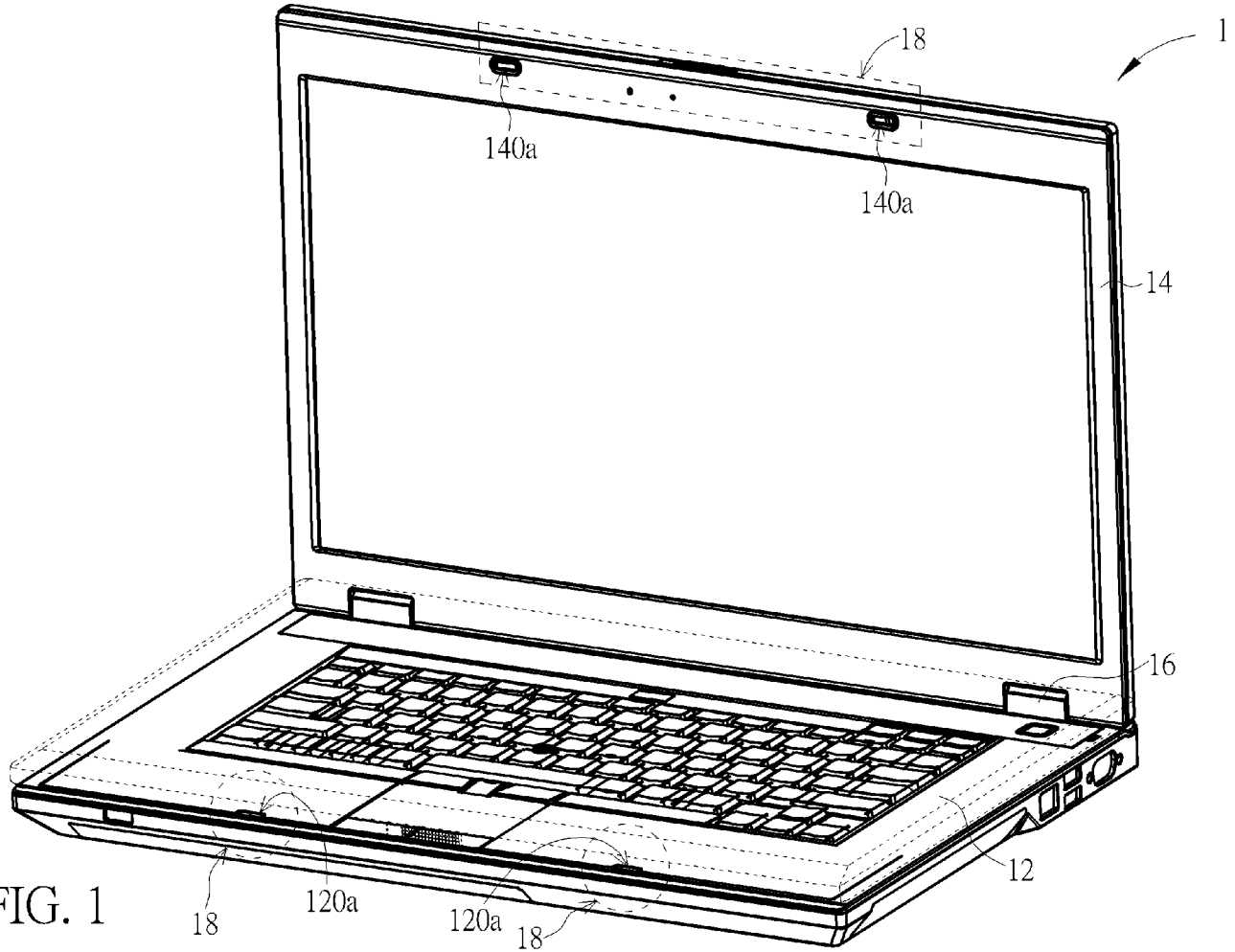
FIG. 1 is a schematic diagram illustrating a portable electronic apparatus according to an embodiment of the invention.

Please refer to FIG. 1, which is a schematic diagram illustrating a portable electronic apparatus 1 according to an embodiment of the invention. The portable electronic apparatus 1 can be but not limited to a notebook and includes base 12, an upper cover 14, a pivotal connecting device 16, and a locking mechanism 18. The base 12 can include a computer system for operating the portable electronic apparatus 1. The upper cover can include a screen, for example capable of displaying information of system states. The base 12 and the upper cover 14 are pivotally connected by the pivotal connecting device 16 so that the portable electronic apparatus 1 has an opened state and a closed state. When the portable electronic apparatus 1 is at the opened state (as shown by solid lines in FIG. 1), the base 12 and the upper cover 14 are unfolded. When the portable electronic apparatus 1 is at the closed state, the base 12 and the upper cover 14 are folded; therein, the upper cover 14 is shown by dashed lines in FIG. 1. The components of the locking mechanism 18 are disposed at corresponding portions of the base 12 and the upper cover 14 respectively (enclosed by dashed circles in FIG. 1). When the portable electronic apparatus 1 is at the closed state, the locking mechanism 18 can lock the base 12 together with the upper cover 14. The movement of the locking mechanism 18 will be described in detail in the following.

Figure 2:
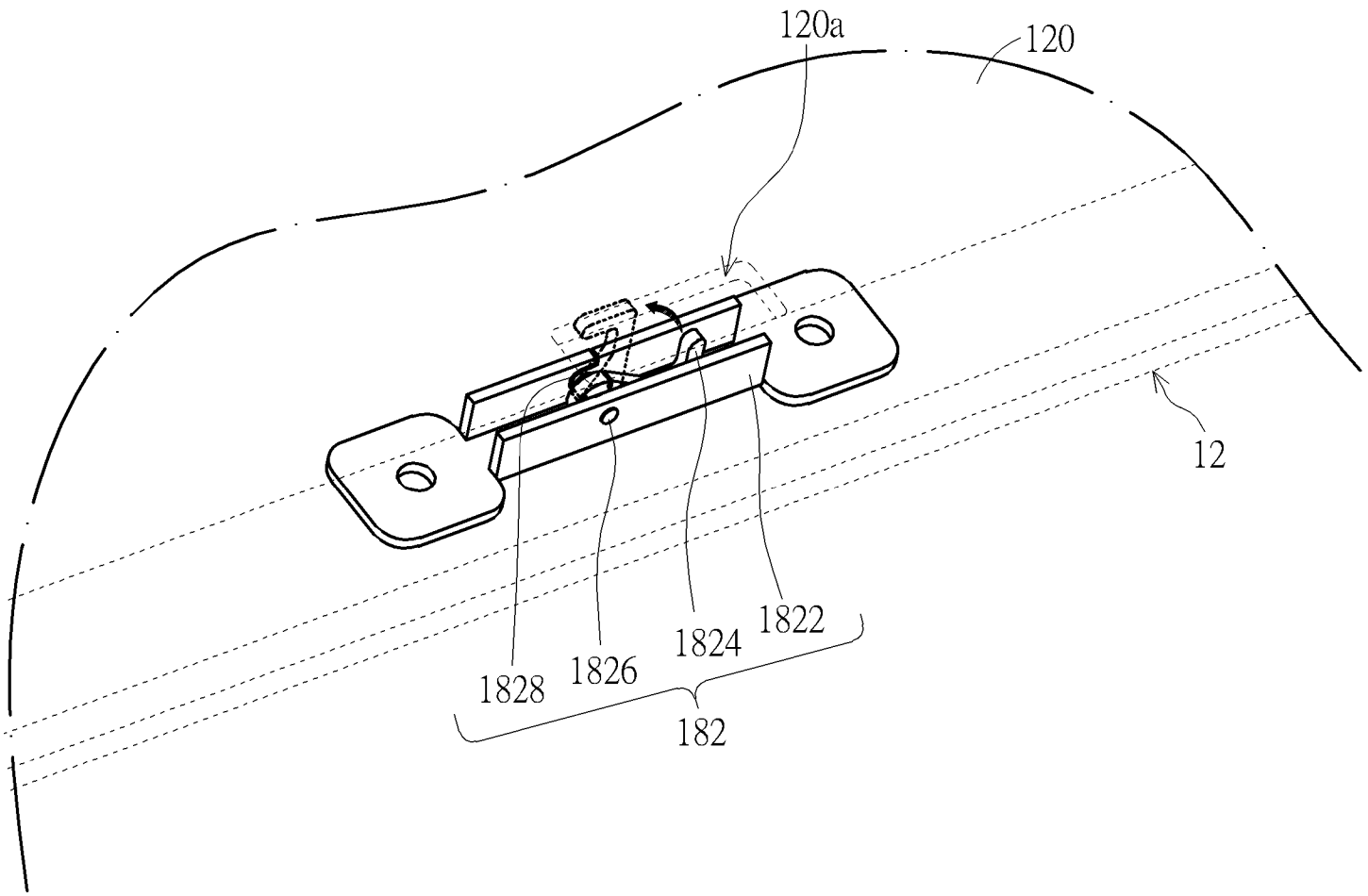
FIG. 2 is a schematic diagram illustrating a portion of a locking mechanism is disposed on a base of the portable electronic apparatus in FIG. 1.
Figure 3:
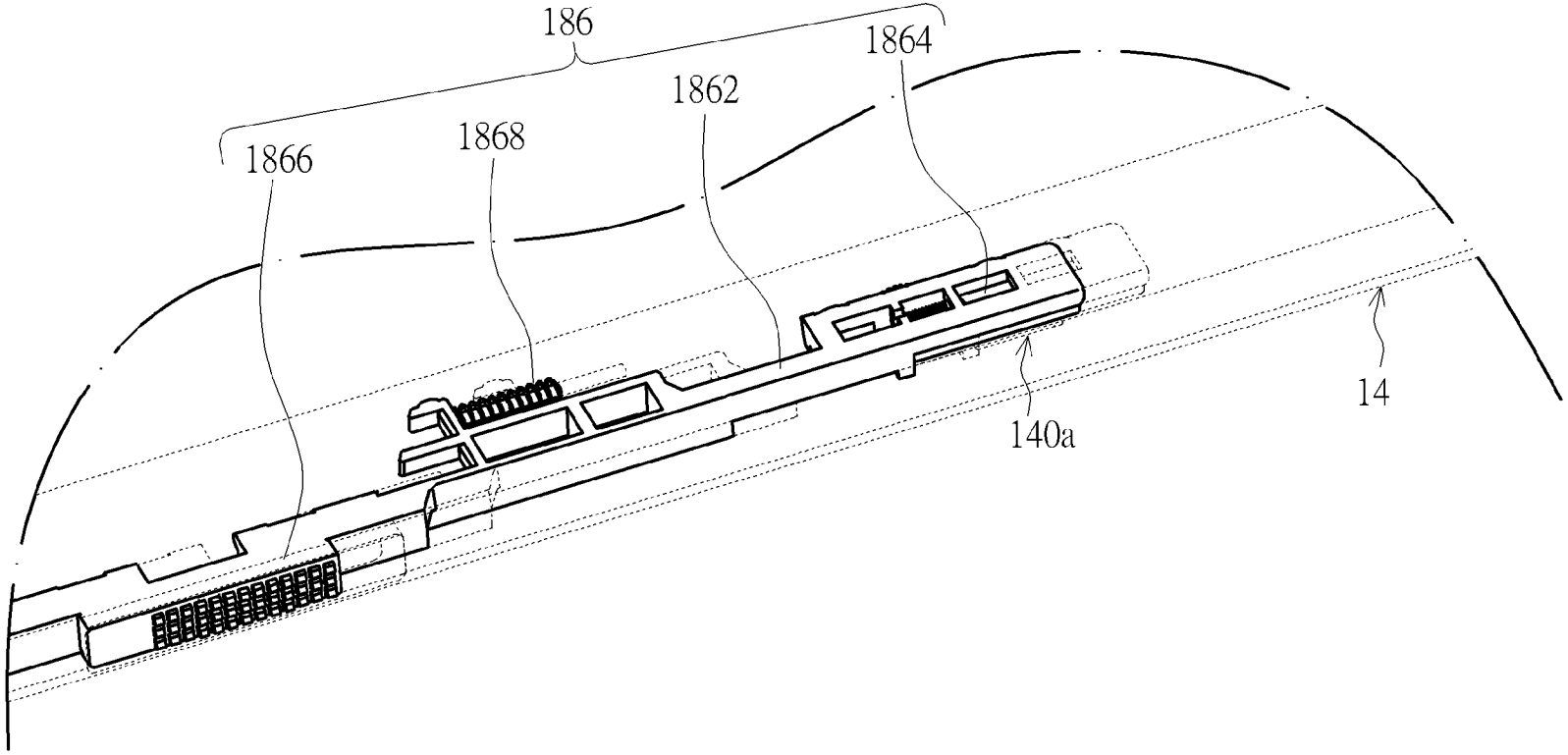
FIG. 3 is a schematic diagram illustrating another portion of the locking mechanism is disposed on an upper cover of the portable electronic apparatus in FIG. 1.

Please refer to FIGS. 1 through 3. FIG. 2 is a schematic diagram illustrating a portion of the locking mechanism 18 is disposed on the base 12. FIG. 3 is a schematic diagram illustrating another portion of the locking mechanism 18 is disposed on the upper cover 14. The locking mechanism 18 includes a hooking component 182, an engagement structure 184, and an actuation component 186. As shown by FIG. 2, the hooking component 182 is disposed in the casing 120 of the base 12 (regarded as the first casing of the invention) and includes a mount 1822, a hook 1824, a pivot 1826, and a resilient part 1828; therein, the base 12 is shown by dashed lines. The casing 120 of the base 12 has an opening **120*a*. The mount 1822 is fixed by screws on the casing 120 of the base 12 corresponding to the opening 120*a*. The hook 1824 is pivotally connected to the mount 1822 by the pivot 1826 and is capable of rotating relative to the casing 120 to extend out of the casing 120 through the opening 120*a*. An end of the resilient part 1828 is fixed on the mount 1822; another end of the resilient part 1828 is fixed on the hook 1824 for providing a resilient force to the hook 1824. The resilient force can produce a first moment M1 (shown by an arc with arrow) on the hook 1824 to urge the hook 1824 to rotate into the casing 120. In the embodiment, the resilient part 1828 is a torsion spring, sleeved on the pivot 1826. In addition to providing the resilient force to the hook 1824, the resilient part 1828 is also capable of retaining the relative position of the hook 1824 to the mount 1822 along the pivot 1826 so as to make the rotation of the hook 1824** more stable.

As shown by FIG. 3, the actuation component 186 is slidably disposed in the casing 140 of the upper cover 14 (regarded as the second casing of the invention) corresponding to the hooking component 182 and includes a sliding part 1862, a magnetic portion 1864, a manipulation portion 1866, and a resilient part 1868. The sliding part 1862 is slidably disposed in the casing 140. The magnetic portion 1864 is disposed on the sliding part 1862 so as to move together with the sliding part 1862; therein, the magnetic portion 1864 has a locking position relative to the casing 140 (as shown by solid lines). The manipulation portion 1866 is connected to the sliding part 1862 and is exposed out of the casing 140 for a user can manipulate to move the sliding part 1862. The resilient part 1868 is connected to the sliding part 1862 and the casing 140 for urging the sliding part 1862 to move such that the magnetic portion 1864 returns back to the locking position. The engagement structure 184 is fixed on the casing 140 corresponding to the opening **120*a*. In the embodiment, the engagement structure 184 is a hole structure 140*a* formed directly on the casing 140. When the base 12 and the upper cover 14 are folded, the hole structure 140*a* is opposite right to the opening 120*a*. The hook 1824 extending out of the casing 120*a* can hook an edge of the hole structure 140*a*. However, the invention is not limited thereto. For example, the engagement structure 184 is an attached component fixed in the casing 140; the casing 140 forms an opening corresponding to the engagement structure 184 for the hook 1824 to pass through and extend into the casing 140 to hook the engagement structure 184**.

Figure 4:
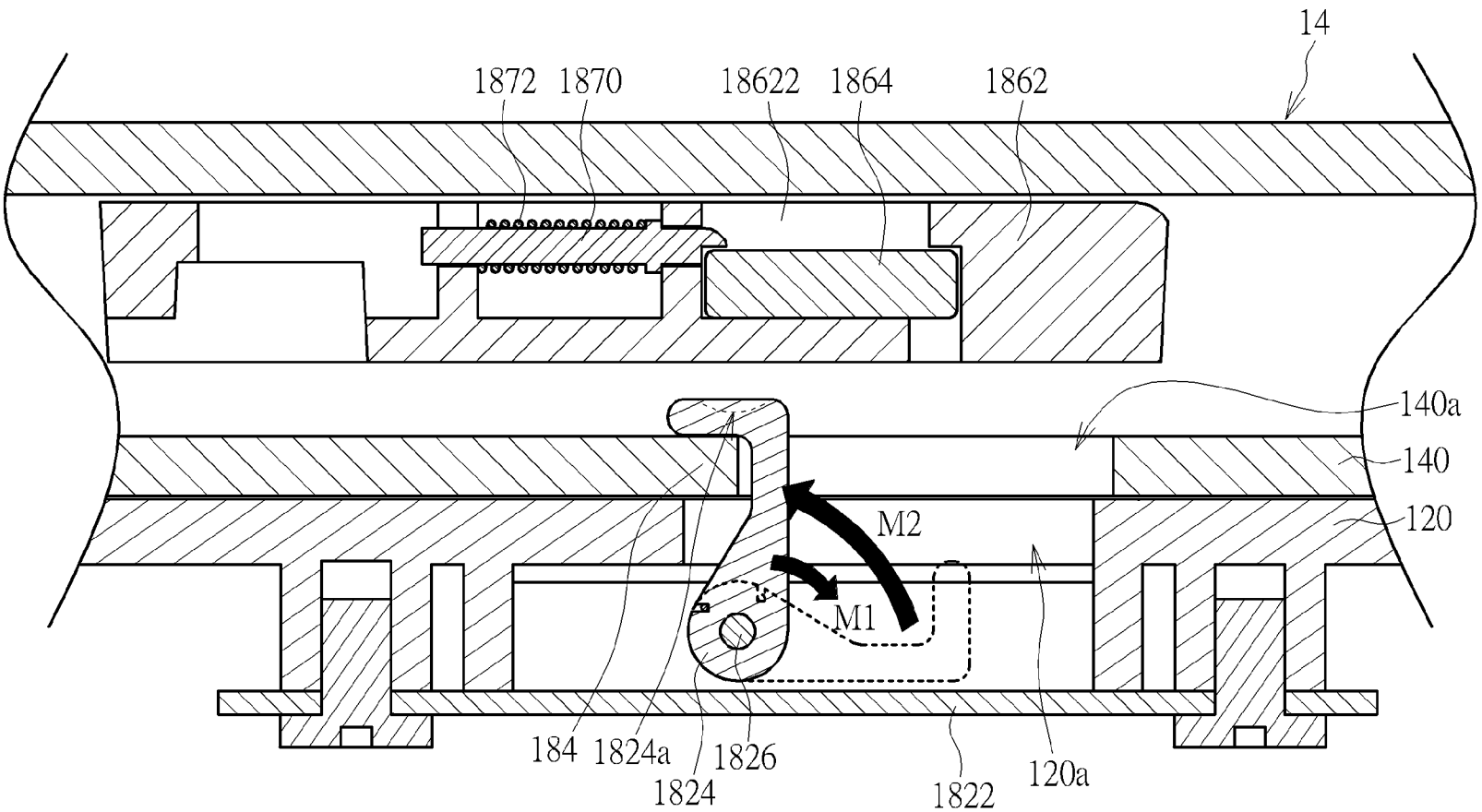
FIG. 4 and FIG. 5 are schematic diagrams illustrating the movement of the locking mechanism.
Figure 5:
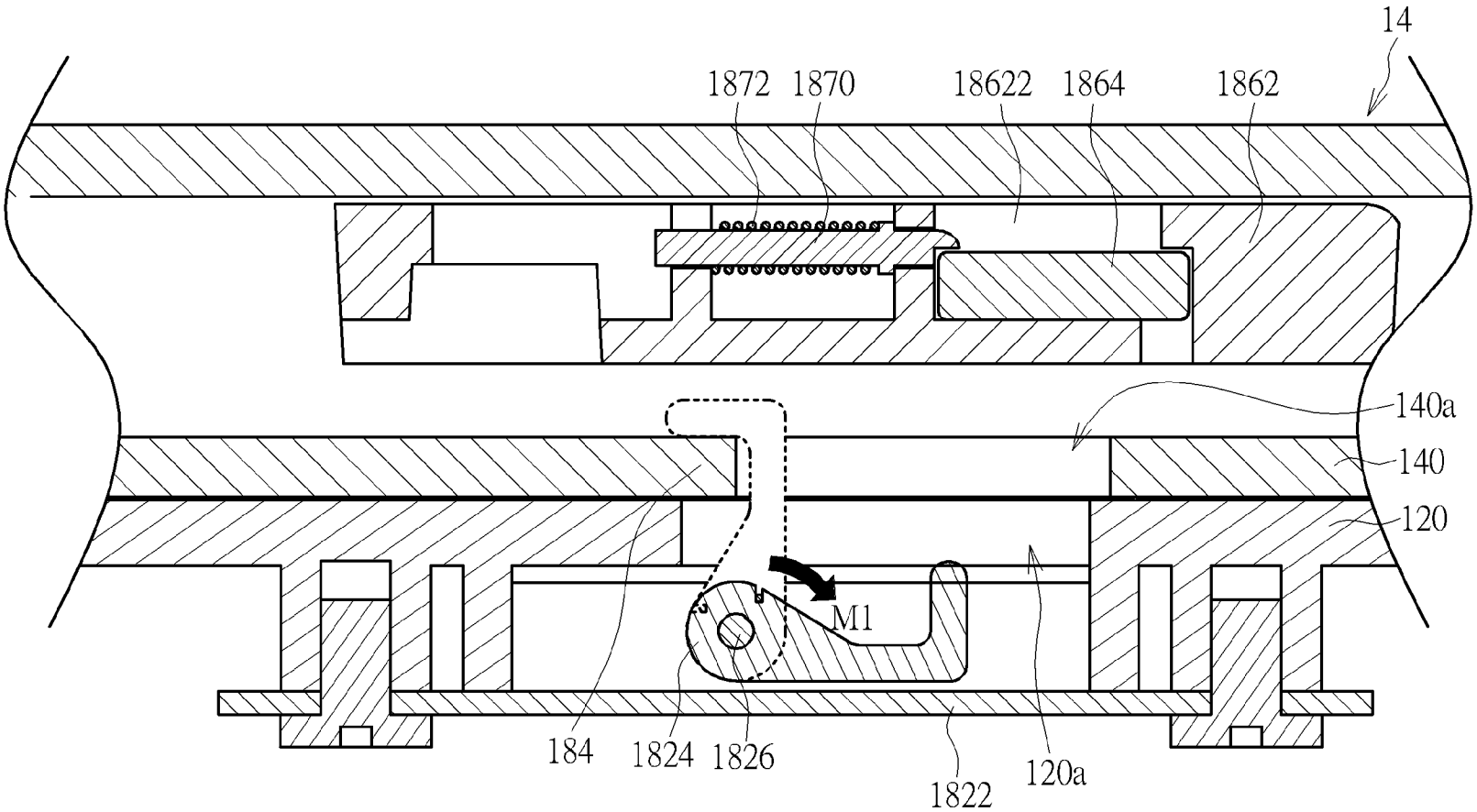

Please refer to FIG. 4 and FIG. 5, which are schematic diagrams illustrating the movement of the locking mechanism 18. Therein, in FIG. 4, the magnetic portion 1864 is located at the locking position; in FIG. 5, the magnetic portion 1864 is away from the locking position. The invention uses magnetic effect to drive the hook 1824 to hook the engagement structure 184 for achieving the purpose of locking the casings 120 and 140. In the embodiment, the magnetic portion 1864 is a magnet. The hook 1824 is made of magnetic material (such as iron), so a magnetic effect can be produced between and by the hook 1824 and the magnetic portion 1864. In practice, the hook 1824 is not limited to be made wholly of magnetic material. For example, the hook 1824 can be provided with a magnetic portion **1824*a* (shown by dashed lines) substantially at the top thereof, such as an object made of magnetic material or a magnet. Such configuration also can produce the magnetic effect between the hook 1824 and the magnetic portion 1864. Therefore, when the magnetic portion 1864 is located at the locking position and the actuation component 186 is close to the hooking component 182 (i.e. the casings 120 and 140 are folded and the magnetic portion 1864 is located at the locking position), a second moment M2 (shown by an arc with arrow) produced by the magnetic effect between the hook 1824 and the magnetic portion 1864 to the hook 1824 will be larger than the first moment M1, so that the hook 1824 will automatically rotate out of the casing 120 to hook the engagement structure 184, as shown by FIG. 4. At this moment, the casings 120 and 140 are locked by the locking mechanism 18, so it is convenient to carry or store the portable electronic apparatus 1. During the above process of the hook 1824 hooking the engagement structure 184, the locking of the casings 120 and 140 is automatically completed without any manipulation by the user to rotate the hook 1824**.

Afterwards, when the actuation component 186 slides such that the magnetic portion 1864 is away from the locking position (for example, the user slides the sliding part 1862 by the manipulation portion 1866), the magnetic effect between the hook 1824 and the magnetic portion 1864 decay so that the second moment M2 is less than the first moment M1, or the second moment M2 can be almost ignored so that under the first moment M1, the hook 1824 is disengaged from the engagement structure 184 and rotates into the casing 120, as shown by FIG. 5. At this moment, the base 12 and the upper cover 14 can be unfolded for use. Because the disengagement of the hook 1824 from the engagement structure 184 is not based on an operation by the user of loading mechanical force directly on the hook 1824 and the engagement structure 184, a force for sliding the manipulation portion 1866 by the user is not required to overcome the structural constraint force on the hook 1824 and the engagement structure 184. Therefore, the user can smoothly manipulate the manipulation portion 1866. Furthermore, the possible abrasion produced between the hook 1824 and the engagement structure 184 during the above disengagement can also be reduced, so as to prolong the service life of the locking mechanism 18.

Figure 6:
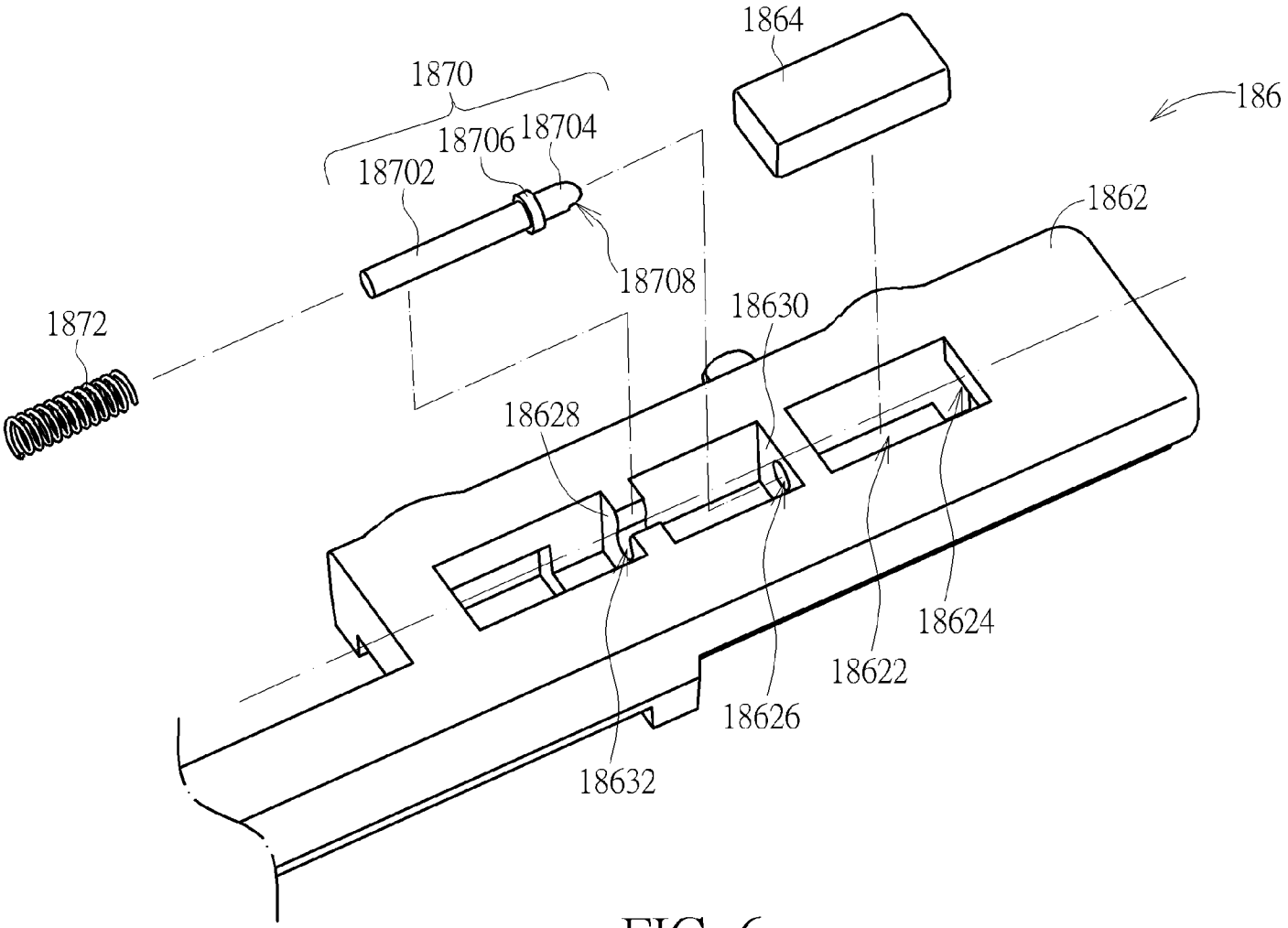
FIG. 6 is an exploded view of a portion of an actuation component of the locking mechanism.
Figure 7:
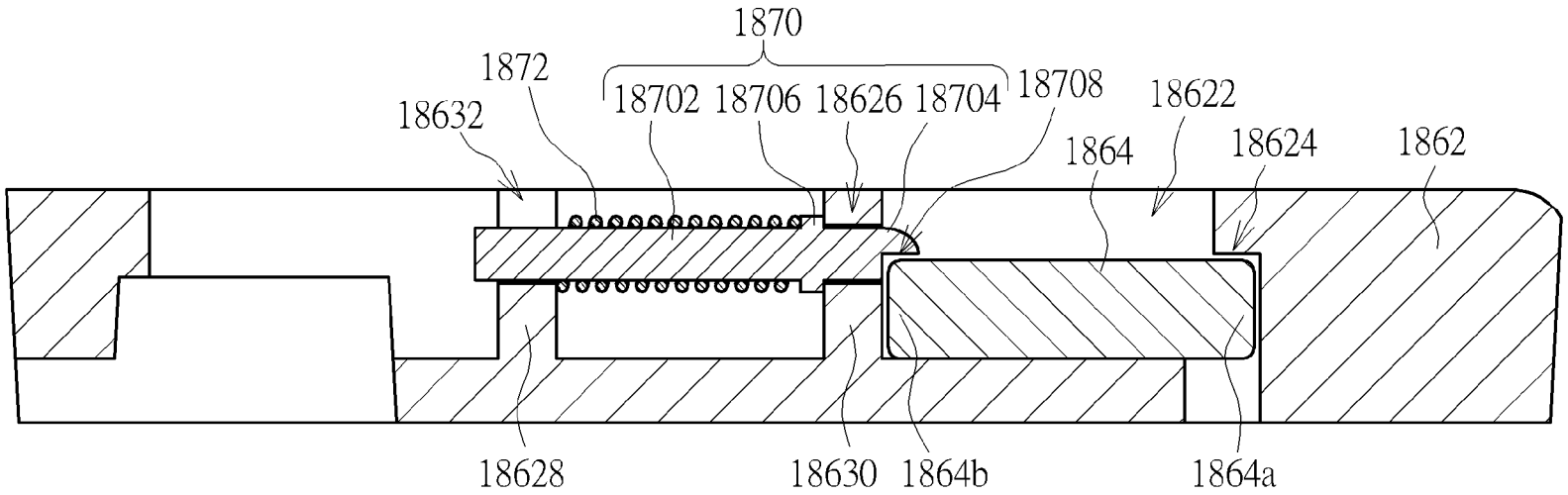
FIG. 7 is a sectional view of a portion of the actuation component of the locking mechanism.

In addition, in the embodiment, the magnetic portion 1864 is disposed on the sliding part 1862 in a detachable way, which is conducive to rework or components recycling. Please refer to FIG. 6 and FIG. 7. FIG. 6 is an exploded view of a portion of the actuation component 186. FIG. 7 is a sectional view of a portion of the actuation component 186. The sliding part 1862 has an accommodating recess 18622. The magnetic portion 1864 is accommodated in the accommodating recess 18622. The accommodating recess 18622 has a restraining wall 18624 for retaining a top surface of a side portion 1864*a* of the magnetic portion 1864. In the embodiment, the accommodating recess 18622 is provided substantially in an L-shaped profile. The restraining wall 18624 is located on the upper portion of a recess region dented sideward inside the accommodating recess 18622. In practice, the restraining wall 18624 also can be formed by protruding a sidewall of the accommodating recess 18622. The sliding part 1862 has a hole 18626 and a supporting wall 18628. The hole 18626 is formed through on a sidewall 18630 of the accommodating recess 18622. The supporting wall 18628 has a C-shaped clamping structure 18632 opposite to the hole 18626. The actuation component 186 further includes a latch part 1870 and a resilient part 1872. The latch part 1870 is movably disposed on the sliding part 1862 close to the accommodating recess 18622 for retaining the magnetic portion 1864 accommodated in the accommodating recess 18622. The latch part 1870 includes a rod body 18702, a rod head 18704, and a protrusion ring 18706. The rod head 18704 is connected to an end of the rod body 18702. The protrusion ring 18706 is protrusively disposed at the end of the rod body 18702. The rod head 18704 is slidably disposed in the hole 18626. The other end of the rod body 18702 is clamped in the C-shaped clamping structure 18632. The protrusion ring 18706 is located between the sidewall 18630 and the supporting wall 18628. The resilient part 1872 is sleeved on the rod body 18702 against and between the protrusion ring 18706 and the supporting wall 18628 for urging the rod head 18704 to extend into the accommodating recess 18622 for retaining the magnetic portion 1864. In the embodiment, the rod head 18704 has a step structure 18708. The rod head 18704 retains a top surface of another opposite side portion 1864*b* of the magnetic portion 1864 by the step structure 18708. Thereby, the magnetic portion 1864 can be accommodated in the accommodating recess 18622 firmly. When the magnetic portion 1864 is required to taken out, the rod head 18704 can be pressed from the inside of the accommodating recess 18622 to shrink into the hole 18626 so that the magnetic portion 1864 can be taken out of the accommodating recess 18622. Similarly, the latch part 1870 can be disengaged from the supporting wall 18628 by the C-shaped clamping structure 18632 and then leave the hole 18626. Then the latch part 1870 together with the resilient part 1872 can be taken out of the sliding part 1862.

Besides, in the above embodiment, the hooking component 182 is disposed on the base 12, and the engagement structure 184 and the actuation component 186 are disposed on the upper cover 14 correspondingly, but the invention is not limited thereto. In practice, the hooking component 182 can be disposed on the upper cover 14 alternatively; the engagement structure 184 and the actuation component 186 are disposed on the base 12 correspondingly. In such configuration, the locking mechanism 18 also can perform locking the base 12 together with the upper cover 14 and preserve the smooth appearance of the portable electronic apparatus 1.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A portable electronic apparatus, comprising:

a first casing having an opening;

a second casing;

a pivotal connecting device, the first casing and the second casing being pivotally connected by the pivotal connecting device; and a locking mechanism, comprising:

a hooking component disposed in the first casing, the hooking component comprising a hook and a first resilient part, the hook having a first magnetic portion and being capable of rotating relative to the first casing to extend out of the first casing through an opening of the first casing, the first resilient part being connected to the hook for providing a first moment to the hook to urge the hook to rotate into the first casing;

an engagement structure fixedly disposed on the second casing, when the first casing and the second casing are closed, the engagement structure being opposite right to the opening such that the hook is capable of hooking the engagement structure; and an actuation component comprising a second magnetic portion and a sliding part, the sliding part being slidably disposed in the second casing, the second magnetic portion being a magnet disposed on the sliding part;

wherein when the second magnetic portion is located at a locking position and the first casing and the second casing are closed, the actuation component is close to the hooking component and a second moment produced by a magnetic effect induced between and by the first magnetic portion and the second magnetic portion to the hook is larger than the first moment and the second magnetic portion magnetically attracts the hook to rotate out of the first casing to hook the engagement structure so as to lock the first casing and the second casing, and when the sliding part slides relative to the second casing such that the second magnetic portion is moved away from the locking position, the second moment is less than the first moment and the first resilient part drives the hook to disengage from the engagement structure to rotate into the first casing so as to unlock the first casing and the second casing.

2. The portable electronic apparatus of claim 1, wherein the hooking component comprises a mount and a pivot, the mount is fixed in the first casing, the hook is pivotally connected to the mount by the pivot, and the first resilient part is connected to the mount and the hook.

3. The portable electronic apparatus of claim 2, wherein the first resilient part is a torsion spring, sleeved on the pivot, an end of the first resilient part is fixed on the mount, and another end of the first resilient part is fixed on the hook.

4. The portable electronic apparatus of claim 1, wherein the hook is made of magnetic material.

5. The portable electronic apparatus of claim 1, wherein the engagement structure is a hole structure, formed on the second casing, and when the first casing and the second casing are closed, the hole structure is opposite right to the opening and the hook is capable of hooking an edge of the hole structure.

6. The portable electronic apparatus of claim 1, wherein the sliding part has an accommodating recess, the actuation component comprises a latch part, the latch part is slidably disposed on the sliding part close to the accommodating recess, and the second magnetic portion is detachably accommodated in the accommodating recess and retained by the latch part.

7. The portable electronic apparatus of claim 6, wherein the sliding part has a hole, formed on a sidewall of the accommodating recess, the latch part comprises a rod body, a rod head, and a protrusion ring, the rod head is connected to an end of the rod body, the protrusion ring is protrusively disposed on the end of the rod body, the rod head is slidably disposed in the hole, the actuation component comprises a second resilient part, sleeved on the rod body against and between the protrusion ring and the sliding part for urging the rod head to extend into the accommodating recess for retaining the second magnetic portion, and the rod head has a step structure for retaining the second magnetic portion.

8. The portable electronic apparatus of claim 6, wherein the accommodating recess has a restraining wall, retaining a top surface of a side portion of the second magnetic portion, and the latch part retains a top surface of another opposite side portion of the second magnetic portion.

9. The portable electronic apparatus of claim 6, wherein the actuation component comprises a third resilient part, connected to the sliding part and the second casing for urging the sliding part to slide so that the second magnetic portion returns back to the locking position.

* * * * *